US007006043B1

(12) United States Patent
Nalbandian

(10) Patent No.: US 7,006,043 B1
(45) Date of Patent: Feb. 28, 2006

(54) WIDEBAND CIRCULARLY POLARIZED SINGLE LAYER COMPACT MICROSTRIP ANTENNA

(75) Inventor: Vahakn Nalbandian, Tinton Falls, NJ (US)

(73) Assignee: The United States of America, as represented by the Secretary of the Army, Washington, DC (US)

( * ) Notice: Subject to any disclaimer, the term of this patent is extended or adjusted under 35 U.S.C. 154(b) by 199 days.

(21) Appl. No.: 10/759,335

(22) Filed: Jan. 16, 2004

(51) Int. Cl.
*H01Q 1/38* (2006.01)

(52) U.S. Cl. ..... 343/700 MS; 343/785; 343/846

(58) Field of Classification Search ..... 343/700 MS, 343/785, 829, 846
See application file for complete search history.

(56) References Cited

U.S. PATENT DOCUMENTS 5,448,252 A * 9/1995 Ali et al. ..... 343/700 MS
6,005,520 A * 12/1999 Nalbandian et al. . 343/700 MS
6,285,325 B1 * 9/2001 Nalbandian et al. . 343/700 MS
6,839,030 B1 * 1/2005 Noujeim ..... 343/700 MS
2004/0227668 A1 * 11/2004 Sievenpiper ..... 343/700 MS

* cited by examiner

*Primary Examiner*—Shih-Chao Chen
(74) *Attorney, Agent, or Firm*—Michael Zelenka; George B. Tereschuk

(57) ABSTRACT

An electrically small wideband circularly polarized single layer compact microstrip antenna that permits a substantial reduction in antenna size is provided, by stacking a semi-circular radiating arch on a dielectric substrate and a conductive ground plane that permits both a considerably reduced antenna length and significantly high efficiency antenna performance. The radiating arch is composed from a group of arc-shaped segments that are each separated by a gap, with one segment having an opening allowing a connector center probe to protrude upwards. In the preferred embodiment, the arc-shaped segments are arranged into a semicircle on the top surface of the dielectric substrate. Other embodiments include an array antenna and a method for decreasing a wideband circularly polarized compact microstrip antenna with a given length, $A_L$.

60 Claims, 4 Drawing Sheets

WIDEBAND CIRCULARLY POLARIZED SINGLE LAYER COMPACT MICROSTRIP ANTENNA

GOVERNMENT INTEREST

The invention described herein may be manufactured, used, imported, sold, and licensed by or for the Government of the United States of America without the payment to me of any royalty thereon.

FIELD OF THE INVENTION

The present invention relates generally to the field of microstrip antennas, and more particularly to wideband circularly polarized single layer compact microstrip antennas.

BACKGROUND OF THE INVENTION

Prior art wideband circularly polarized microstrip antennas generally feature elements that are larger than one wavelength, which is not useful for array antennas. There has been a long-felt need for smaller sized antennas, particularly antenna sizes that are smaller than a wavelength. This invention's long-awaited electrically small wideband circularly polarized compact microstrip antenna with a uniquely shaped radiating arch offers a number of advantages over prior art antennas. An electrically small wideband circularly polarized compact microstrip antenna with a size smaller than a wavelength can be a quite advantageous compact antenna or excellent antenna array structure. The electrically small wideband circularly polarized single layer compact microstrip antenna of the present invention provides the same high efficiency as conventional microstrip antennas, but it also offers a number of key advantages that permit significant decreases in antenna size, without suffering from the disadvantages, limitations and shortcomings of prior art antenna structures.

The present invention fulfills the long-standing need for a significantly reduced antenna length and an electrically small antenna with a microstrip antenna structure fabricated with a segmented radiating arch stacked on a dielectric substrate along with an innovative electrical feed arrangement that produces circularly polarized leaky-wave radiation and permits both a considerably reduced antenna length and high efficiency antenna performance, without suffering from the disadvantages, shortcomings and limitations of prior art microstrip antennas. The antenna of the present invention has a very wide circularly polarized bandwidth for its small size, because it is a successful leaky wave antenna with a bandwidth that is further enhanced due to the curvature of its structure which causes wave propagation path length difference, whether the portion of the wave is propagating near the structures R1 or R2 radius or anywhere in between.

SUMMARY OF THE INVENTION

It is an object of this invention to provide an electrically small wideband circularly polarized single layer compact microstrip antenna.

It is another object of this invention to provide an electrically small wideband circularly polarized single layer compact microstrip antenna that permits a substantial reduction in antenna size.

It is yet another object of this invention to provide an electrically small wideband circularly polarized single layer compact microstrip antenna having a semicircular radiating arch stacked on a dielectric substrate and an electrically-isolated feed arrangement that permits both a considerably reduced antenna length and significantly high efficiency antenna performance.

These and other objects are advantageously accomplished with the present invention providing an electrically small wideband circularly polarized single layer compact microstrip antenna comprising stacking a radiating arch, a dielectric substrate and a ground plane to provide a substantially reduced antenna length and significantly high efficiency antenna performance. This invention also encompasses an antenna array with a number of radiating arches and methods for providing substantial reduction in antenna size with an electrically small wideband circularly polarized single layer compact microstrip antenna.

DETAILED DESCRIPTION OF THE DRAWINGS

Figure 1:
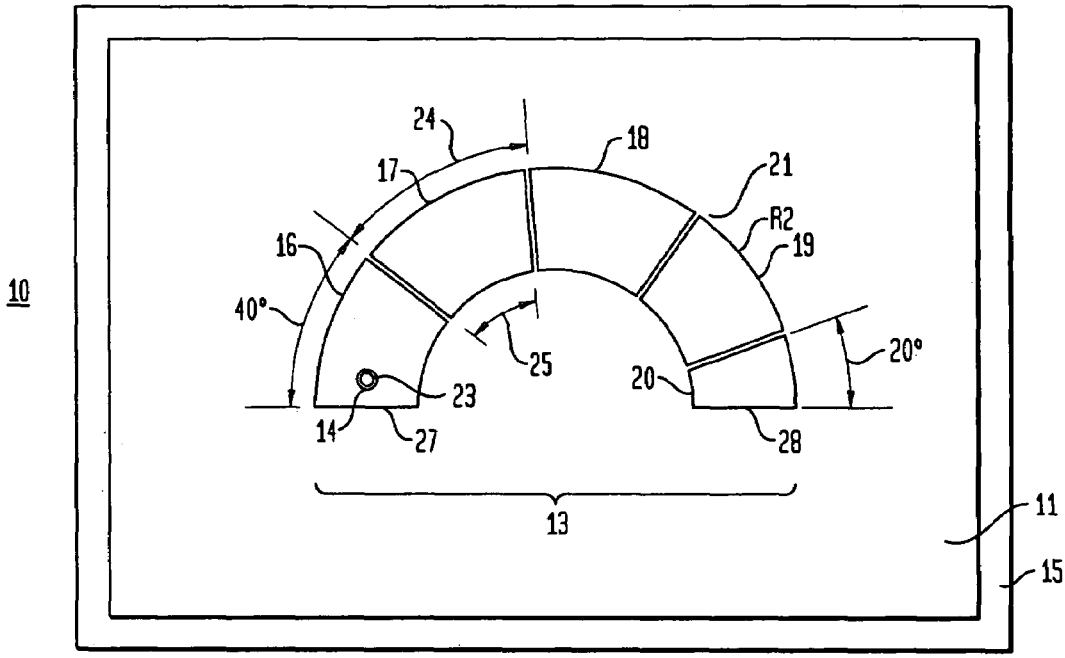
FIG. 1 is a top view of the semicircular radiating arch stacked on the top surface of the dielectric substrate in accordance with the present invention.

The electrically small wideband circularly polarized single layer compact microstrip antenna of the present invention advantageously comprises a radiating arch, a microstrip dielectric substrate, a ground plane and a coaxial connector that is insulated from one segment of the radiating arch in an innovative stacking arrangement that provides an electrically small, reduced length for a microstrip antenna. Leaky-wave radiation can be excited in the waveguide of periodically placed microstrip patches on a dielectric substrate stacked on a ground plane. When several segments of the radiating arch form a microstrip antenna cavity with narrow gaps between the segments, the radiation is emitted not only from the conventional radiation edges but also from the dielectric substrate's top surface gaps, which is usually covered by a single patch in a prior art rectangular microstrip antenna. In fact, the radiation from the top surface gaps of the conventional leaky-wave microstrip antenna is much stronger than the radiation emitted from the edge of the dielectric substrate surfaces. When the radiated power increases relative to the stored energy in the cavity, the Q factor becomes small, which results in a large bandwidth. However, impedance matching will be harder to accomplish for a large bandwidth because the resistive part of the input impedance exceeds the maximum value when a conventional electrical feed is used. Therefore, a different type of electrical feed arrangement is needed for impedance matching when the Q value becomes very small.

In order to overcome the shortcomings and limitations of prior art leaky-wave microstrip antennas and incorporate a different type of electrical feed arrangement, the present invention provides a center probe that is insulated from the radiating patches so that the electrical feed current is confined to the center probe to provide an increased input resistance. This insulated feed approach, the stacking arrangement and the circularly polarized radiation all result in a significantly reduced antenna length that is substantially shorter than conventional prior art microstrip antennas, without suffering from any of the disadvantages, drawbacks and limitations associated with much longer prior art conventional antennas.

The size of any microstrip antenna is determined by the wavelength within the substrate. For example, the length of a rectangular microstrip antenna is about half of the wavelength within the dielectric medium under a radiating patch. In order to reduce the size of the segments of the radiating arch, the dielectric constant must be increased substantially for a smaller effective wavelength in the medium. The antenna's efficiency usually decreases with a substrate having a high dielectric constant. This invention's electrically small wideband circularly polarized single layer compact microstrip antenna advantageously combines a number of antenna components, including a microstrip dielectric substrate, in an innovative stacking arrangement that provides a significant reduction in antenna length.

Referring now to the drawings, FIG. 1 is a top view of the electrically small wideband circularly polarized single layer compact microstrip antenna 10 with a semicircular radiating arch 13 located on a top surface 11 of a microstrip dielectric substrate 12, not shown in this drawing, which is stacked on ground plane 15. The radiating arch 13 further comprises a plurality of arc-shaped segments 16–20 arranged into a semicircle in the preferred embodiment on the top surface 11. Segment 16 includes an opening 14 allowing a connector center probe 23 to protrude upwards. Segments 16–20 are each separated by a gap 21, but for the sake of clarity, only a single gap 21 is depicted between segments 18 and 19.

Figure 2:
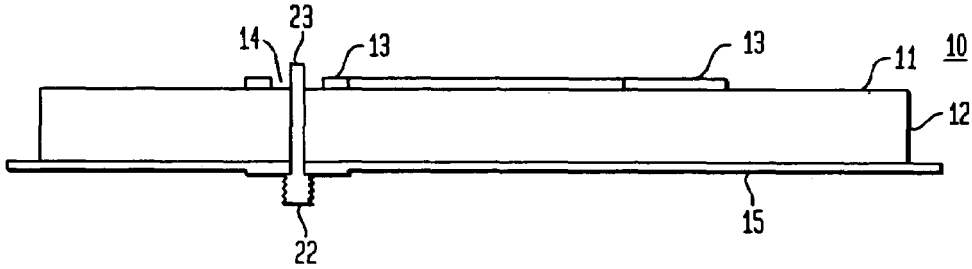
FIG. 2 is a cutaway side view of the stacked semicircular radiating arch, dielectric substrate and ground plane of the present invention.

FIG. 2 is a cutaway side view of the electrically small wideband circularly polarized single layer compact microstrip antenna 10 of the present invention, using like numerals for like structures, showing the radiating arch 13 located on the microstrip dielectric substrate 12 which is stacked on top of a ground plane 15. A coaxial connector center probe 23 of a coaxial connector 22 projects upwards through the ground plane 15, dielectric substrate 12 and opening 14 and extends slightly above segment 16. The center probe 23 is dimensioned with a diameter that is smaller than opening 14 in order to prevent electrical contact between the center probe 23 and segment 16 of the radiating arch 13 and to reduce the current in the coaxial connector 22 to provide improved impedance matching. The present invention focuses the antenna length reduction effort on the configuration of the radiating arch 13 and the thickness relationships between the dielectric substrate 12, radiating arch 13 and ground plane 15 to reduce the wavelength within the microstrip media without making the antenna inefficient. In all embodiments, the radiating arch 13 is thinner than dielectric substrate 12, and dielectric substrate 12 is generally thicker than the ground plane 15. In the preferred embodiment, the radiating arch 13 further comprises a semicircular shape, but other curvilinear shapes are also within the contemplation of this invention.

Figure 3:
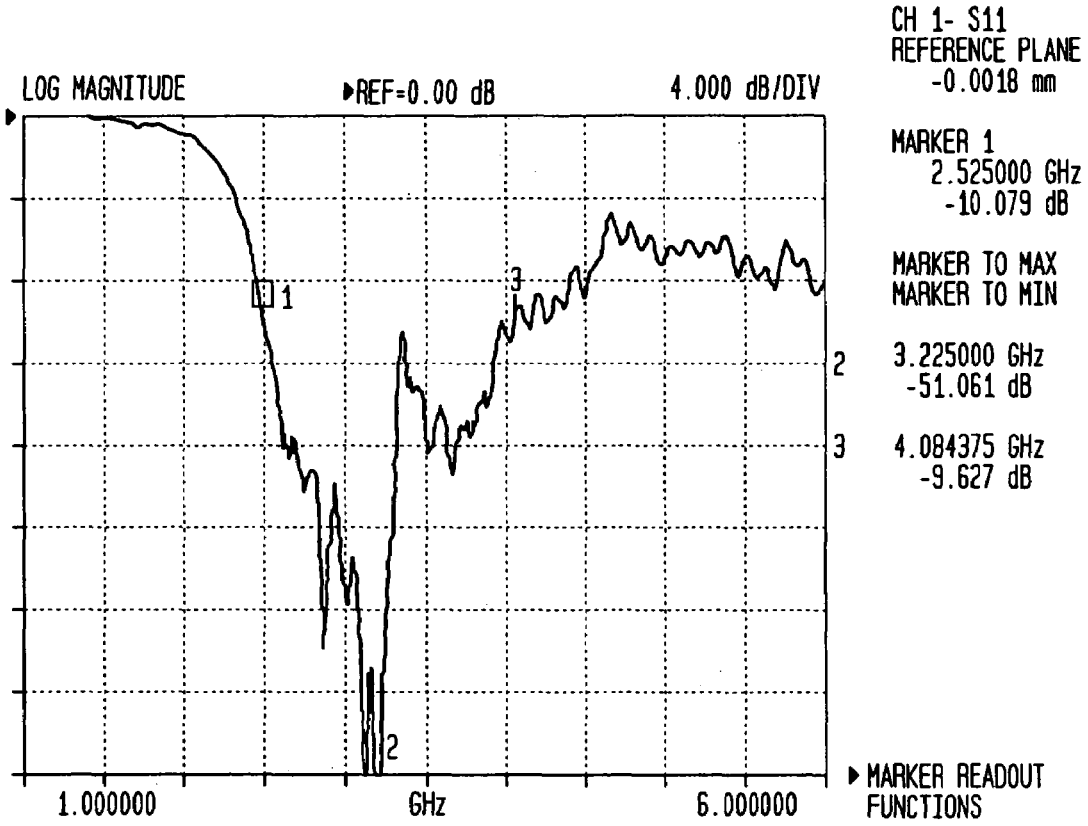
FIG. 3 is a chart showing the frequency bandwidth of the antenna of the present invention.

FIG. 3 is a chart showing the frequency bandwidth of 2.52 to 4.08 GHz for the electrically small wideband circularly polarized single layer compact microstrip antenna of the present invention. This chart demonstrates that this invention's antenna provides a 47% frequency bandwidth, which is substantially larger that the 30% bandwidth achieved by prior art linear leaky wave antennas. Referring back to FIG. 1, the significantly increased 47% bandwidth of this invention's electrically small wideband circularly polarized single layer compact microstrip antenna is caused by the path length difference between the gaps 21 due to the curvature of the semicircular radiating arch 13. It is further noted either increasing the path length difference between the outer edge 25 of radiating arch 13 or the inner edge 26 can advantageously increase bandwidth because the inner semicircle along inner edge 26 is substantially shorter than the outer semicircle formed by outer edge 25. Other improvements in bandwidth of antenna 10 may also be achieved by increasing the ratio of R2/R1. Additionally, by adjusting the size of gap 21, the amount of radiation from each gap 21 can be controlled to compensate for the loss of energy, because the gaps 21 are further away from the input signal.

The electrical fields in this invention's electrically small wideband circularly polarized single layer compact microstrip antenna 10 are perpendicular to all straight edges of the segments 16–20 found across the gaps 21 and the ends 27 and 28. As the energy leaks by propagating under the segments 16–20 of the radiating arch 13, the electrical filed rotates. When the wave propagates a quarter guide wavelength in the dielectric substrate 12 under the radiating element 13, the antenna gap direction also rotates 90°, thus making the antenna circularly polarized. The radiating arch 13 may be made from any conductive metal, and in the preferred embodiment it is composed of copper. Ground plane 13 may also be made from conductive materials such as copper and aluminum. The low-loss dielectric substrate 12 may be composed of any suitable dielectric material such as Duroid™.

Figure 4:
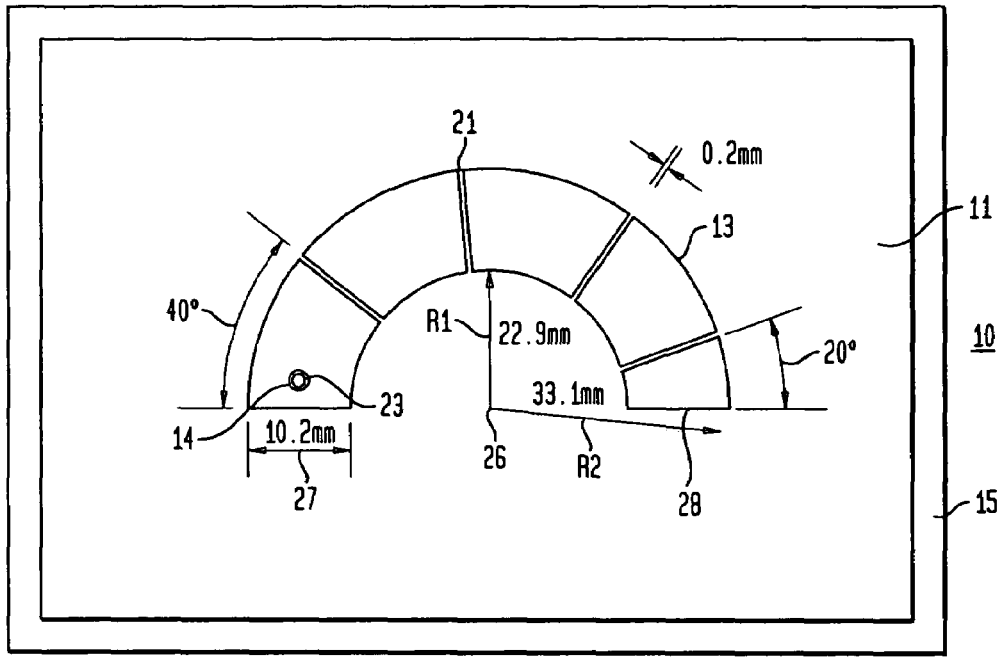
FIG. 4 a top view of the electrically small wideband circularly polarized single layer compact microstrip antenna with representative dimensions in accordance with the present invention.

FIG. 4 is a top view of the electrically small wideband circularly polarized single layer compact microstrip antenna with representative dimensions for the preferred embodiment in accordance with the present invention. In the preferred embodiment, the free space wavelength of the center frequency of antenna 10 is approximately 90 mm, and the area of the semicircular radiating arch 13 is about 65 mm in length and 33 mm in width. The curvature of radiating arch 13 is 180°. The gap 21 can measure 0.2 mm. The diameter of opening 14 is 1.5 mm and the diameter of the center probe 23 is 1.25 mm. R1, which is the inner radius of the radiating arch 13 measures 22.9 mm, and R2, which is the outer radius of the radiating arch 13 measures 33.1 mm. The center of opening 14 is 2.5 mm from the edge and centered between R1 and R2.

Figure 5:
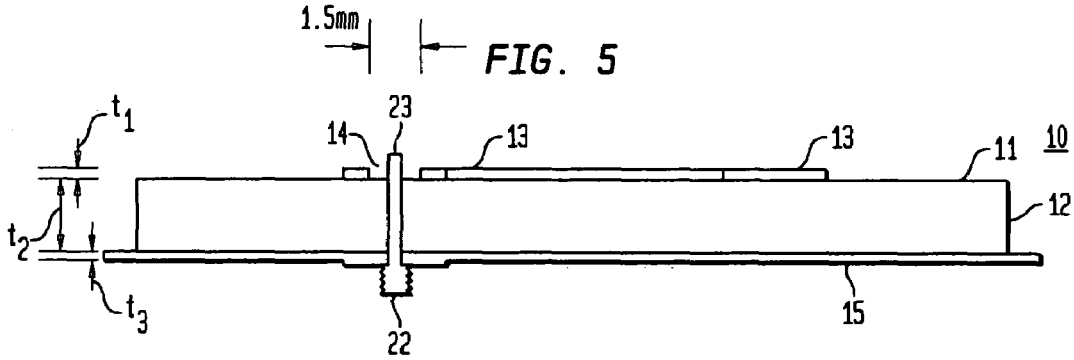
FIG. 5 is a cutaway side view of the electrically small wideband circularly polarized single layer compact microstrip antenna with representative dimensions in accordance with the present invention.

FIG. 5 is a cutaway side view of the electrically small wideband circularly polarized single layer compact microstrip antenna 10 with representative dimensions in accordance with the present invention. The dielectric substrate 12, having a thickness, $t_2$, of 11.1 mm is thicker than the ground plane 15, having a thickness, $t_3$, of 0.8 mm, which, in turn, is thicker than radiating arch 13, with a thickness, $t_1$, of 0.035 mm. Generally speaking, dielectric substrate 12 thickness, $t_2$, is thicker than ground plane 15 thickness, $t_3$, and ground plane 15 thickness, $t_3$, is either similar to, or thicker than, radiating arch thickness, $t_1$.

A number of variations of the electrically small wideband circularly polarized single layer compact microstrip antenna 10 are considered to be within the contemplation of this invention. For example, the arc-shaped segments 16–20 may be flat and can be arranged in a semicircular shape, the plurality of gaps 21 can be narrow and may have a gap width of about 0.2 mm, the ground plane and radiating arch can each be composed of a conductive metal, including copper. Additionally, the increased bandwidth being achieved by increasing a ratio of R2/R1 or by adjusting said gap width.

Figure 6:
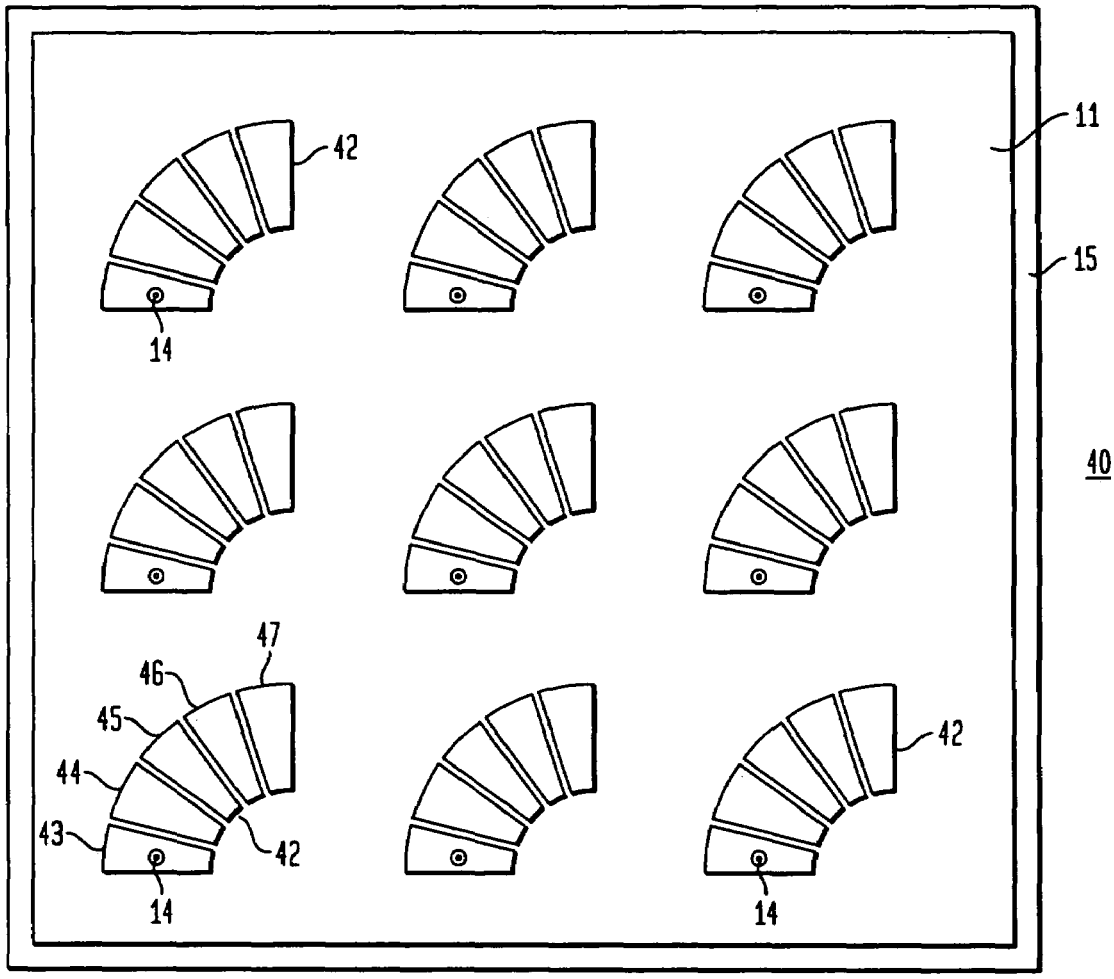
FIG. 6 is a top view of an array of radiating arches stacked on the dielectric substrate in another embodiment of the present invention.

The compactness of this invention's electrically small wideband circularly polarized single layer compact microstrip antenna 10 also permits the antenna array embodiment depicted in FIG. 6, however, in that case it is essential that the array element be fabricated in a size of about one half a wavelength or less. Using higher dielectric material or having the leaky wave antenna rotate less than 180° can assist the designer in achieving further reductions of antenna element size. One example of an antenna array with less than 180° rotation is the 90° rotation array depicted in FIG. 6. Referring now to FIG. 6, which is a top view of the electrically small wideband circularly polarized single layer compact microstrip antenna array 40, where like numerals are employed for similar structures, there is depicted a group of radiating arches 42 disposed on a top surface 11 of a microstrip dielectric substrate, which is stacked on a ground plane 15. Each radiating arch 42 has an opening 14, and one of the radiating arches 42 is depicted with segments 43–47. The antenna array 40 provides a decreased antenna array length, $A_{AD}$, which is shorter than a given antenna array length, $A_{AL}$.

In this particular antenna array 40 depicts a 3 by 3 element array structure, which can be in any M by N array where M and N are any numbers. In this antenna array 40 of the present invention, instead of feeding the nine radiating arches 42 with nine coaxial connectors, one can simplify and economize the power supply requirements by using a stripline power divider network behind the ground plane and feeding the RF energy by using coupling holes through the ground plane, by means well known in the antenna arts. Many of the variations that apply to the antenna embodiments can also apply to the antenna array.

The present invention also encompasses a method for decreasing a wideband circularly polarized compact microstrip antenna with a given length, $A_L$, comprising the steps of arranging a plurality of flat arc-shaped segments in a semicircle, the segments terminating in straight edges that define a group of narrow gaps between the segments; forming a radiating arch from the segments, with the radiating arch having an inner edge, an outer edge, a first straight end, a second straight end and a path length difference between the narrow gaps in the radiating arch, the inner edge being shorter than said outer edge; placing the radiating arch on a top surface of a microstrip dielectric substrate, the dielectric substrate being thicker than the radiating arch; stacking the microstrip dielectric substrate on a conductive ground plane, with the dielectric substrate being at least as thick as said ground plane and projecting a center probe of a coaxial connector upwardly through the ground plane, dielectric substrate and an opening in a first segment, the opening having an opening diameter greater than a probe diameter of the center probe in order to prevent electrical contact between the center probe and the first segment. Forming the antenna with the given length, $A_L$, and a given bandwidth to generate a leaky wave radiation, the antenna being electrically small; generating a plurality of electrical fields perpendicular to the first end, the second end and the straight edges and permitting the leaky wave radiation to leak by propagating under the segments, the radiating arch, perpendicular electrical fields and path length difference advantageously causing an increased bandwidth and resulting in a wideband circularly polarized radiation with a 47% bandwidth permitting a decreased antenna length, $A_D$. Many of the variations that apply to the device embodiments can also apply to this invention's method.

It is to be understood that such other features and modifications to the foregoing detailed description are within the contemplation of the invention, which is not limited by this description. As will be further appreciated by those skilled in the art, any number of configurations, as well any number of combinations of circuits, differing materials and dimensions can achieve the results described herein. Accordingly, the present invention should not be limited by the foregoing description, but only by the appended claims.

What I claim is:

1. An electrically small, wideband circularly polarized compact microstrip antenna, comprising:

a radiating arch on a top surface of a microstrip dielectric substrate, said radiating arch further comprising a plurality of arc-shaped segments terminating in straight edges defining a plurality of gaps between said segments;

said microstrip dielectric substrate being stacked on a conductive ground plane;

said radiating arch, being thinner than said dielectric substrate, and said dielectric substrate being at least as thick as said ground plane;

a center probe of a coaxial connector projects upwardly through said ground plane, said dielectric substrate and an opening in a first one of said segments, said opening having an opening diameter greater than a probe diameter of said center probe prevents an electrical contact between the said center probe and said first segment;

said antenna having a given length, $A_L$, and a given bandwidth, generates a leaky wave radiation;

said radiating arch having an inner edge, an outer edge, a first straight end, a second straight end and a path length difference between said plurality of gaps, said inner edge being shorter than said outer edge;

said radiating arch generating a plurality of electrical fields perpendicular to said first end, said second end and said plurality of straight edges; and said radiating arch, said perpendicular electrical fields and said path length difference permits said leaky wave radiation to leak by propagating under said segments, advantageously causing an increased bandwidth and resulting in a wideband circularly polarized radiation with a 47% bandwidth permitting a decreased antenna length, $A_D$.

2. The electrically small, wideband circularly polarized compact microstrip antenna, as recited in claim 1, further comprising said decreased antenna length, $A_D$, being shorter than said given length, $A_L$.

3. The electrically small, wideband circularly polarized compact microstrip antenna, as recited in claim 2, further comprising said radiating arch causing said leaky wave radiation to travel along said radiating arch in a circular direction.

4. The electrically small, wideband circularly polarized compact microstrip antenna, as recited in claim 3, further comprising said arc-shaped segments being flat.

5. The electrically small, wideband circularly polarized compact microstrip antenna, as recited in claim 4, further comprising said plurality of flat arc-shaped segments being arranged in a semicircle.

6. The electrically small, wideband circularly polarized compact microstrip antenna, as recited in claim 5, further comprising said plurality of gaps being narrow.

7. The electrically small, wideband circularly polarized compact microstrip antenna, as recited in claim 6, further comprising said plurality of gaps having a gap width of about 0.2 mm.

8. The electrically small, wideband circularly polarized compact microstrip antenna, as recited in claim 7, further comprising said inner edge being shorter than said outer edge creates said path length difference between said plurality of narrow gaps.

9. The electrically small, wideband circularly polarized compact microstrip antenna, as recited in claim 8, further comprising said dielectric substrate having a thickness, $t_2$, greater than a thickness, $t_3$, of said ground plane.

10. The electrically small, wideband circularly polarized compact microstrip antenna, as recited in claim 9, further comprising said thickness, $t_2$, of the dielectric substrate being greater than a thickness, $t_1$, of said radiating arch.

11. The electrically small, wideband circularly polarized compact microstrip antenna, as recited in claim 10, further comprising said ground plane being composed of a conductive metal.

12. The electrically small, wideband circularly polarized compact microstrip antenna, as recited in claim 11, further comprising said radiating arch being composed of a conductive metal.

13. The electrically small, wideband circularly polarized compact microstrip antenna, as recited in claim 12, wherein said conductive metal is copper.

14. The electrically small, wideband circularly polarized compact microstrip antenna, as recited in claim 13, further comprising said increased bandwidth being achieved by increasing a ratio of R2/R1.

15. The electrically small, wideband circularly polarized compact microstrip antenna, as recited in claim 14, further comprising said increased bandwidth being achieved by adjusting said gap width.

16. The electrically small, wideband circularly polarized compact microstrip antenna, as recited in claim 15, further comprising said dielectric substrate being composed of a low loss dielectric material.

17. An electrically small, wideband circularly polarized compact microstrip antenna array, comprising:

a plurality of radiating arches located on a top surface of a microstrip dielectric substrate, said plurality of radiating arches further comprising a plurality of arc-shaped segments terminating in straight edges defining a plurality of gaps between said segments;

said microstrip dielectric substrate being stacked on a conductive ground plane;

said radiating arches, being thinner than said dielectric substrate, and said dielectric substrate being at least as thick as said ground plane;

each of said plurality of radiating arches having a first segment with an opening;

a power supply network disposed beneath said ground plane feeds RF power to a plurality of center probes projecting upwardly through said ground plane, said dielectric substrate and said openings, said openings each having an opening diameter greater than a probe diameter of said center probe prevents an electrical contact between the said center probe and said first segments;

said antenna array having a given antenna array length, $A_{AL}$, and a given bandwidth, generates a leaky wave radiation, said antenna array being configured in a size of about one half of a wavelength;

each of said plurality of radiating arches having an inner edge, an outer edge, a first straight end, a second straight end and a path length difference between said plurality of gaps, said inner edges being shorter than said outer edges;

said plurality of radiating arches generating a plurality of electrical fields perpendicular to said first end, said second end and said plurality of straight edges; and said plurality of radiating arches, said perpendicular electrical fields and said path length differences permit said leaky wave radiation to leak by propagating under said segments, advantageously causing an increased bandwidth and resulting in a wideband circularly polarized radiation with a 47% bandwidth permitting a decreased antenna array length, $A_{AD}$.

18. The electrically small, wideband circularly polarized compact microstrip antenna array, as recited in claim 17, further comprising said decreased antenna length, $A_{AD}$, being shorter than said given length, $A_{AL}$.

19. The electrically small, wideband circularly polarized compact microstrip antenna array, as recited in claim 18, further comprising said plurality of radiating arches causing said leaky wave radiation to travel along said plurality of radiating arches in a circular direction.

20. The electrically small, wideband circularly polarized compact microstrip antenna array, as recited in claim 19, further comprising said arc-shaped segments being flat.

21. The electrically small, wideband circularly polarized compact microstrip antenna array, as recited in claim 20, further comprising said radiating arch further comprising a plurality of flat arc-shaped segments arranged in a 90° rotation.

22. The electrically small, wideband circularly polarized compact microstrip antenna array, as recited in claim 21, further comprising said plurality of gaps being narrow.

23. The electrically small, wideband circularly polarized compact microstrip antenna array, as recited in claim 22, further comprising each of said plurality of gaps having a gap width of about 0.2 mm.

24. The electrically small, wideband circularly polarized compact microstrip antenna array, as recited in claim 23, further comprising said inner edges being shorter than said outer edges creating a plurality of path length differences between said plurality of narrow gaps.

25. The electrically small, wideband circularly polarized compact microstrip antenna array, as recited in claim 24, further comprising said dielectric substrate having a thickness, $t_2$, greater than a thickness, $t_3$, of said ground plane.

26. The electrically small, wideband circularly polarized compact microstrip antenna array, as recited in claim 25, further comprising said thickness, $t_2$, of the dielectric substrate being greater than a thickness, $t_1$, of said plurality of radiating arches.

27. The electrically small, wideband circularly polarized compact microstrip antenna array, as recited in claim 26, further comprising said ground plane being composed of a conductive metal.

28. The electrically small, wideband circularly polarized compact microstrip antenna array, as recited in claim 27, further comprising said plurality of radiating arches being composed of a conductive metal.

29. The electrically small, wideband circularly polarized compact microstrip antenna array, as recited in claim 28, wherein said conductive metal is copper.

30. The electrically small, wideband circularly polarized compact microstrip antenna array, as recited in claim 29, further comprising said increased bandwidth being achieved by adjusting said gap widths.

31. The electrically small, wideband circularly polarized compact microstrip antenna array, as recited in claim 30, further comprising said dielectric substrate being composed of a low loss dielectric material.

32. An electrically small, wideband circularly polarized compact microstrip antenna, comprising:

a radiating arch on a top surface of a microstrip dielectric substrate, said radiating arch further comprising a plurality of flat arc-shaped segments arranged in a semicircle, said segments terminating in straight edges defining a plurality of narrow gaps between said segments;

said microstrip dielectric substrate being stacked on a conductive ground plane;

said radiating arch, a thickness, $t_1$, less than a thickness, $t_2$, of said dielectric substrate, said thickness, $t_2$, being greater than a thickness, $t_3$, of said ground plane;

a center probe of a coaxial connector projects upwardly through said ground plane, said dielectric substrate and an opening in a first one of said segments, said opening having an opening diameter greater than a probe diameter of said center probe prevents an electrical contact between the said center probe and said first segment;

said antenna having a given length, $A_L$, and a given bandwidth, generates a leaky wave radiation;

said radiating arch having an inner edge, an outer edge, a first straight end, a second straight end and a path length difference between said plurality of gaps, said inner edge being shorter than said outer edge;

said radiating arch generating a plurality of electrical fields perpendicular to said first end, said second end and said plurality of straight edges; and said radiating arch, said perpendicular electrical fields and said path length difference permits said leaky wave radiation to leak by propagating under said segments, advantageously causing an increased bandwidth and resulting in a wideband circularly polarized radiation with a 47% bandwidth permitting a decreased antenna length, $A_D$.

33. The electrically small, wideband circularly polarized compact microstrip antenna, as recited in claim 32, further comprising said decreased antenna length, $A_D$, being shorter than said given length, $A_L$.

34. The electrically small, wideband circularly polarized compact microstrip antenna, as recited in claim 33, further comprising said radiating arch causing said leaky wave radiation to travel along said radiating arch in a circular direction.

35. The electrically small, wideband circularly polarized compact microstrip antenna, as recited in claim 34, further comprising said center probe extending upwardly slightly above said first segment.

36. The electrically small, wideband circularly polarized compact microstrip antenna, as recited in claim 35, further comprising said plurality of gaps having a gap width of 0.2 mm.

37. The electrically small, wideband circularly polarized compact microstrip antenna, as recited in claim 36, further comprising said inner edge being shorter than said outer edge creates said path length difference between said plurality of narrow gaps.

38. The electrically small, wideband circularly polarized compact microstrip antenna, as recited in claim 37, further comprising said ground plane being composed of a conductive metal.

39. The electrically small, wideband circularly polarized compact microstrip antenna, as recited in claim 38, further comprising said radiating arch being composed of a conductive metal.

40. The electrically small, wideband circularly polarized compact microstrip antenna, as recited in claim 39, wherein said conductive metal is copper.

41. The electrically small, wideband circularly polarized compact microstrip antenna, as recited in claim 40, further comprising said dielectric substrate being composed of a low loss dielectric material.

42. The electrically small, wideband circularly polarized compact microstrip antenna, as recited in claim 41, further comprising said low loss dielectric material being Duroid™.

43. The electrically small, wideband circularly polarized compact microstrip antenna, as recited in claim 42, further comprising said increased bandwidth being achieved by increasing a ratio of R2/R1.

44. The electrically small, wideband circularly polarized compact microstrip antenna, as recited in claim 43, further comprising said increased bandwidth being achieved by adjusting said gap width.

45. The electrically small, wideband circularly polarized compact microstrip antenna, as recited in claim 44, further comprising said perpendicular electrical fields and said path length difference causing said increased bandwidth.

46. The electrically small, wideband circularly polarized compact microstrip antenna, as recited in claim 45, further comprising said perpendicular electrical fields and said path length difference causing said increased bandwidth because said inner edge is substantially shorter than said outer edge.

47. A method for decreasing a wideband circularly polarized compact microstrip antenna with a given length, $A_L$, comprising the steps of:

arranging a plurality of flat arc-shaped segments in a semicircle, said segments terminating in straight edges defining a plurality of narrow gaps between said segments;

forming a radiating arch from said segments, said radiating arch having an inner edge, an outer edge, a first straight end, a second straight end and a path length difference between said plurality of narrow gaps in said radiating arch, said inner edge being shorter than said outer edge;

placing said radiating arch on a top surface of a microstrip dielectric substrate, said dielectric substrate being thicker than said radiating arch;

stacking said microstrip dielectric substrate on a conductive ground plane, said dielectric substrate being at least as thick as said ground plane;

projecting a center probe of a coaxial connector upwardly through said ground plane, said dielectric substrate and an opening in a first one of said segments, said opening having an opening diameter greater than a probe diameter of said center probe prevents an electrical contact between said center probe and said first segment;

forming said antenna with said given length, $A_L$, and a given bandwidth to generate a leaky wave radiation, said antenna being electrically small;

generating a plurality of electrical fields perpendicular to said first end, said second end and said plurality of straight edges; and permitting said leaky wave radiation to leak by propagating under said segments, said radiating arch, said perpendicular electrical fields and said path length difference advantageously causing an increased bandwidth and resulting in a wideband circularly polarized radiation with a 47% bandwidth permitting a decreased antenna length, $A_D$.

48. The method for decreasing a wideband circularly polarized compact microstrip antenna with a given length, $A_L$, as recited in claim 47, further comprising the step of providing said decreased antenna length, $A_D$, shorter than said given length, $A_L$.

49. The method for decreasing a wideband circularly polarized compact microstrip antenna with a given length, $A_L$, as recited in claim 48, further comprising the step of causing said leaky wave radiation to travel along said radiating arch in a circular direction.

50. The method for decreasing a wideband circularly polarized compact microstrip antenna with a given length, $A_L$, as recited in claim 49, further comprising the step of configuring said center probe to extend upwardly slightly above said first segment.

51. The method for decreasing a wideband circularly polarized compact microstrip antenna with a given length, $A_L$, as recited in claim 50, further comprising the step of forming said plurality of gaps with a gap width of about 0.2 mm.

52. The method for decreasing a wideband circularly polarized compact microstrip antenna with a given length, $A_L$, as recited in claim 51, further comprising the step of providing said inner edge shorter than said outer edge to create said path length differences between said plurality of narrow gaps.

53. The method for decreasing a wideband circularly polarized compact microstrip antenna with a given length, $A_L$, as recited in claim 52, further comprising the step of forming said ground plane from a conductive metal.

54. The method for decreasing a wideband circularly polarized compact microstrip antenna with a given length, $A_L$, as recited in claim 53, further comprising the step of forming said radiating arch from said conductive metal.

55. The method for decreasing a wideband circularly polarized compact microstrip antenna with a given length, $A_L$, as recited in claim 54, wherein said conductive metal is copper.

56. The method for decreasing a wideband circularly polarized compact microstrip antenna with a given length, $A_L$, as recited in claim 55, further comprising the step of forming said dielectric substrate from a low-loss dielectric material.

57. The method for decreasing a wideband circularly polarized compact microstrip antenna with a given length, $A_L$, as recited in claim 56, wherein said low-loss dielectric material is Duroid™.

58. The method for decreasing a wideband circularly polarized compact microstrip antenna with a given length, $A_L$, as recited in claim 57, further comprising the step of increasing a ratio of R2/R1 to achieve said increased bandwidth.

59. The method for decreasing a wideband circularly polarized compact microstrip antenna with a given length, $A_L$, as recited in claim 58, further comprising the step of adjusting said gap width to achieve said increased bandwidth.

60. The method for decreasing a wideband circularly polarized compact microstrip antenna with a given length, $A_L$, as recited in claim 59, wherein said perpendicular electrical fields and said path length difference cause said increased bandwidth because said inner edge is substantially shorter than said outer edge.

* * * * *